US011192709B2

(12) United States Patent
Furusawa

(10) Patent No.: US 11,192,709 B2
(45) Date of Patent: Dec. 7, 2021

(54) DISPENSER FOR AEROSOL CONTAINERS

(71) Applicant: YOSHINO KOGYOSHO CO., LTD., Tokyo (JP)

(72) Inventor: Mitsuo Furusawa, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/756,444

(22) PCT Filed: Sep. 3, 2018

(86) PCT No.: PCT/JP2018/032658
§ 371 (c)(1),
(2) Date: Apr. 15, 2020

(87) PCT Pub. No.: WO2019/087560
PCT Pub. Date: May 9, 2019

(65) Prior Publication Data

US 2021/0188525 A1 Jun. 24, 2021

(30) Foreign Application Priority Data

Oct. 31, 2017 (JP) ..... JP2017-211238
Jun. 28, 2018 (JP) ..... JP2018-123675

(51) Int. Cl.
*B65D 83/20* (2006.01)

(52) U.S. Cl.
CPC ..... *B65D 83/206* (2013.01)

(58) Field of Classification Search
CPC .... B65D 83/206; B65D 83/68; B65D 83/201; B65D 83/205; B65D 83/40; A61B 5/01;
(Continued)

(56) References Cited

U.S. PATENT DOCUMENTS 3,469,746 A * 9/1969 Melocchi ..... B65D 83/40 222/182
4,427,134 A * 1/1984 Almouli ..... B65D 83/206 215/201

(Continued)

FOREIGN PATENT DOCUMENTS

DE 202015007112 U1 * 12/2015
EP 1757536 A1 * 2/2007

(Continued)

OTHER PUBLICATIONS

Nov. 20, 2018 International Search Report issued in International Patent Application No. PCT/JP2018/032658.

(Continued)

*Primary Examiner* — Vishal Pancholi
*Assistant Examiner* — Bob Zadeh
(74) *Attorney, Agent, or Firm* — Oliff PLC

(57) ABSTRACT

A dispenser for aerosol containers includes: a nozzle; and a cover including an operating portion. One of the operating portion and the nozzle includes a sliding portion capable of depressing the nozzle to a predetermined depression position together with a plurality of stems while sliding on a slid portion provided at an other one of the operating portion and the nozzle to a termination, with a depression operation on the operating portion. A vibration generation portion that generates vibration as a result of entry of the sliding portion is provided at the termination of the slid portion.

12 Claims, 16 Drawing Sheets

(58) Field of Classification Search
CPC ..... A61B 5/026; A61B 5/14542; A61B 8/06; A61B 8/4477; A61B 8/5223; A61M 1/14; A61M 1/3626; A61M 1/3663; A61M 2205/3313; A61M 2205/3334; A61M 2205/3368; A61M 2205/3375; A61M 39/281; G01F 1/00; G01F 1/66; G01F 1/662; G01F 1/667; G01F 1/668; G01F 1/74; G01F 15/022; G16H 50/30
See application file for complete search history.

(56) References Cited

U.S. PATENT DOCUMENTS 5,624,055 A * 4/1997 Clanet ..... B65D 83/206 222/135
5,918,780 A * 7/1999 Tanaka ..... B65D 83/206 222/402.13
5,971,230 A * 10/1999 Tanaka ..... B65D 83/44 222/402.11
2002/0117516 A1* 8/2002 Lasserre ..... B05B 11/0089 222/145.5
2007/0108231 A1* 5/2007 Gray ..... B01F 13/002 222/135

FOREIGN PATENT DOCUMENTS

| | | | |
|---|---|---|---|
| EP | 2982616 | A1 | 2/2016 |
| GB | 2496563 | A | 5/2013 |
| JP | 2007-099278 | A | 4/2007 |
| JP | 2007-269384 | A | 10/2007 |
| JP | 2010-052812 | A | 3/2010 |
| JP | 2016-190669 | A | 11/2016 |
| JP | 2017-030799 | A | 2/2017 |

OTHER PUBLICATIONS

May 5, 2020 International Preliminary Report on Patentability issued in International Patent Application No. PCT/JP2018/032658.
May 27, 2021 Office Action issued in Chinese Patent Application No. 201880067797.3.
Jun. 24, 2021 Extended European Search Report issued in European Patent Application No. 18872674.9.

* cited by examiner

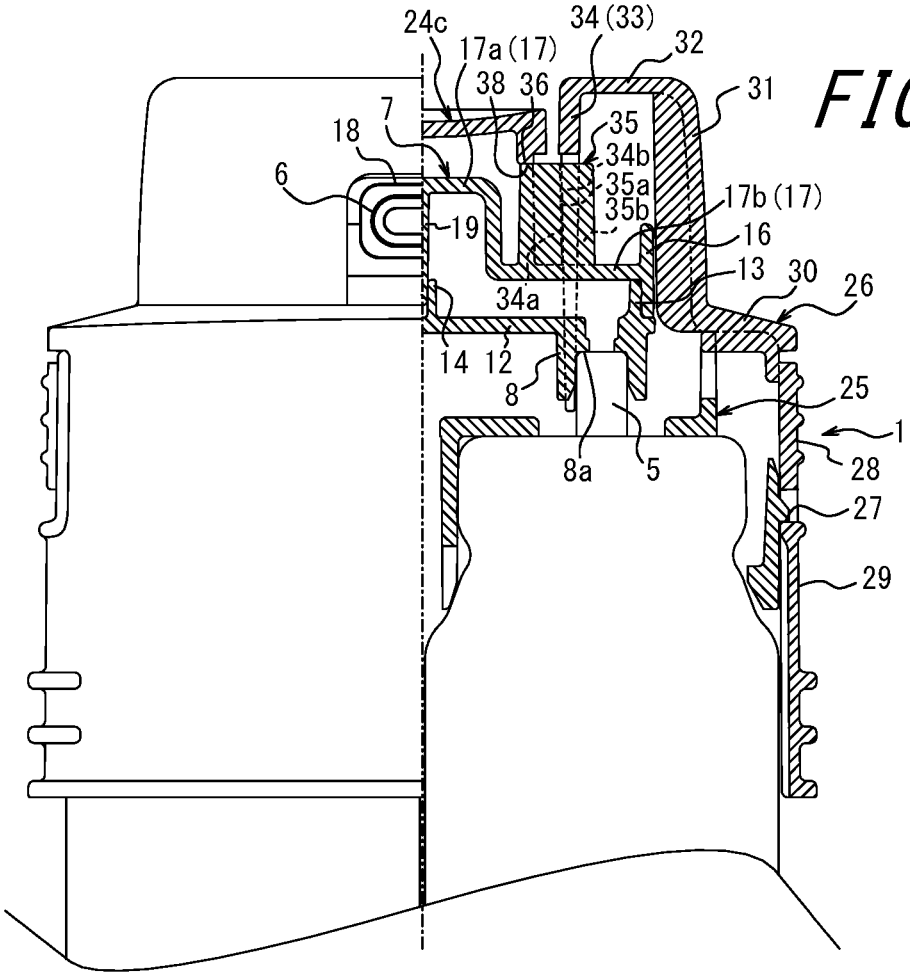
FIG. 2
FIG. 3
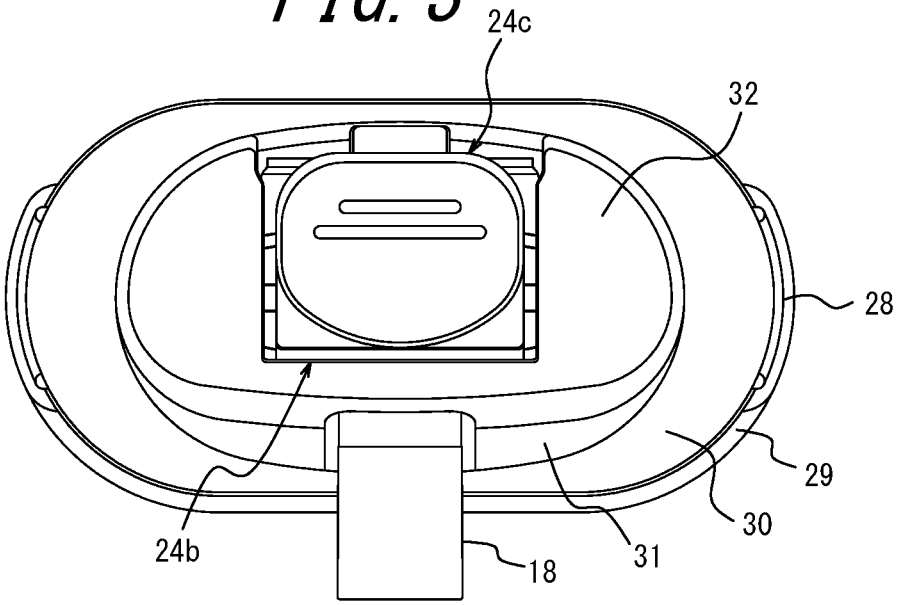

DISPENSER FOR AEROSOL CONTAINERS

TECHNICAL FIELD

The present disclosure relates to a dispenser for aerosol containers.

BACKGROUND

A dispenser for aerosol containers that is attachable to a plurality of aerosol containers of single stem type arranged in parallel or a single aerosol container of multiple stem type is known. Such a dispenser for aerosol containers may include: a nozzle including a dispensing port for contents and integrally connectable to a pair of stems; and a cover including a support portion integrally connectable to a pair of aerosol container bodies and an operating portion connected to the support portion so as to be vertically swingable, as described in PTL 1 for example.

CITATION LIST

Patent Literature

PTL 1: JP 2016-190669 A

SUMMARY

Technical Problem

The dispenser for aerosol containers as described in PTL 1 is required to equalize, as much as possible, the flow volumes of the contents flowing out of the pair of stems depressed together with the nozzle by a depression operation on the operating portion. In the case where the contents in the containing portions corresponding to the respective stems are of different types, if the flow volumes of the contents flowing out of the pair of stems are unequal, desired effects by mixing these contents cannot be achieved. In the case where the contents in the containing portions are of the same type, if the flow volumes of the contents flowing out of the pair of stems are unequal, the remaining amounts of the contents in the respective containing portions become nonuniform. Consequently, when one containing portion becomes empty, a sufficient flow volume of the contents cannot be obtained.

With the conventional dispenser for aerosol containers, however, there are cases where the user does not depress the operating portion to a sufficient position, and as a result the contents flow out of only one stem or the flow volumes of the contents flowing out of both stems become significantly nonuniform.

It could therefore be helpful to provide a dispenser for aerosol containers that can reduce the nonuniformity of the flow volumes of the contents flowing out of a pair of stems.

Solution to Problem

A dispenser for aerosol containers according to an aspect of the present disclosure is a dispenser for aerosol containers that is attachable to a plurality of aerosol containers of single stem type arranged in parallel or a single aerosol container of multiple stem type, the dispenser for aerosol containers comprising: a nozzle including a dispensing port for contents, and integrally connectable to a plurality of stems; and a cover including a support portion integrally connectable to one or more aerosol container bodies, and an operating portion connected to the support portion so as to be vertically swingable, wherein one of the operating portion and the nozzle includes a sliding portion capable of depressing the nozzle to a predetermined depression position together with the plurality of stems while sliding on a slid portion provided at an other one of the operating portion and the nozzle to a termination, with a depression operation on the operating portion, and a vibration generation portion that generates vibration as a result of entry of the sliding portion is provided at the termination of the slid portion.

In the dispenser for aerosol containers according to the present disclosure, the vibration generation portion may be formed by a step portion that makes the termination of the slid portion a convex or concave corner portion.

In the dispenser for aerosol containers according to the present disclosure, the corner portion may be convex.

In the dispenser for aerosol containers according to the present disclosure, the operating portion may include the sliding portion, and the nozzle may include the slid portion and the vibration generation portion.

In the dispenser for aerosol containers according to the present disclosure, the predetermined depression position may be a position at which flow volumes of contents flowing out of the plurality of stems are at a maximum.

In the dispenser for aerosol containers according to the present disclosure, the support portion of the cover may include a pair of guiding walls forming guiding surfaces facing each other, the nozzle may include a pair of guided convex portions forming guided surfaces guided by the guiding surfaces, each of the pair of guided convex portions may include the slid portion and the vibration generation portion, and the operating portion may include a pair of sliding portions that are each the sliding portion.

In the dispenser for aerosol containers according to the present disclosure, each of the pair of guiding walls may include a guiding slit extending in a depression direction of the plurality of stems, and each of the pair of guided convex portions may include a guided piece that is guided by the guiding slit.

In the dispenser for aerosol containers according to the present disclosure, the nozzle may include an abutting portion that abuts an abutted portion of the support portion so as to correct a tilt of the nozzle in a plane perpendicular to a direction in which the plurality of stems are arranged in parallel, with the depression operation on the operating portion.

In the dispenser for aerosol containers according to the present disclosure, the nozzle may include a dispensing tube having the dispensing port at a tip thereof, and the abutting portion may be formed by a lower end of a rib vertically suspended from the dispensing tube.

In the dispenser for aerosol containers according to the present disclosure, the operating portion may include a top plate connected to the support portion so as to be vertically swingable, and a bottom plate fixed to a lower surface of the top plate, and one of the bottom plate and the nozzle may include the sliding portion, and an other one of the bottom plate and the nozzle may include the slid portion and the vibration generation portion.

In the dispenser for aerosol containers according to the present disclosure, the bottom plate may be connected to the top plate via a hinge.

In the dispenser for aerosol containers according to the present disclosure, the bottom plate may be formed by a member different from the top plate, and made of a material harder than the top plate.

Advantageous Effect

It is thus possible to provide a dispenser for aerosol containers that can reduce the nonuniformity of the flow volumes of the contents flowing out of a pair of stems.

BRIEF DESCRIPTION OF THE DRAWINGS

In the accompanying drawings:

FIG. 2 is a partial sectional front view of the aerosol device illustrated in FIG. 1;

FIG. 3 is a top view of the aerosol device illustrated in FIG. 1;

DETAILED DESCRIPTION

A dispenser for aerosol containers according to each of various embodiments of the present disclosure will be described in detail below, with reference to the drawings. In each embodiment, "lateral" (right-left direction) denotes the direction in which a pair of stems are arranged (e.g. the right-left direction in FIG. 2), "downward" denotes the stem push direction (e.g. downward in FIG. 2), "upward" denotes the direction opposite to the downward direction, "forward" denotes the direction that is perpendicular to the lateral direction and the up-down direction (vertical direction) and is from the side on which the stems are located to the side on which a dispensing port of a nozzle is located (e.g. the left direction in FIG. 1), and "backward" denotes the direction opposite to the forward direction.

Figure 1:
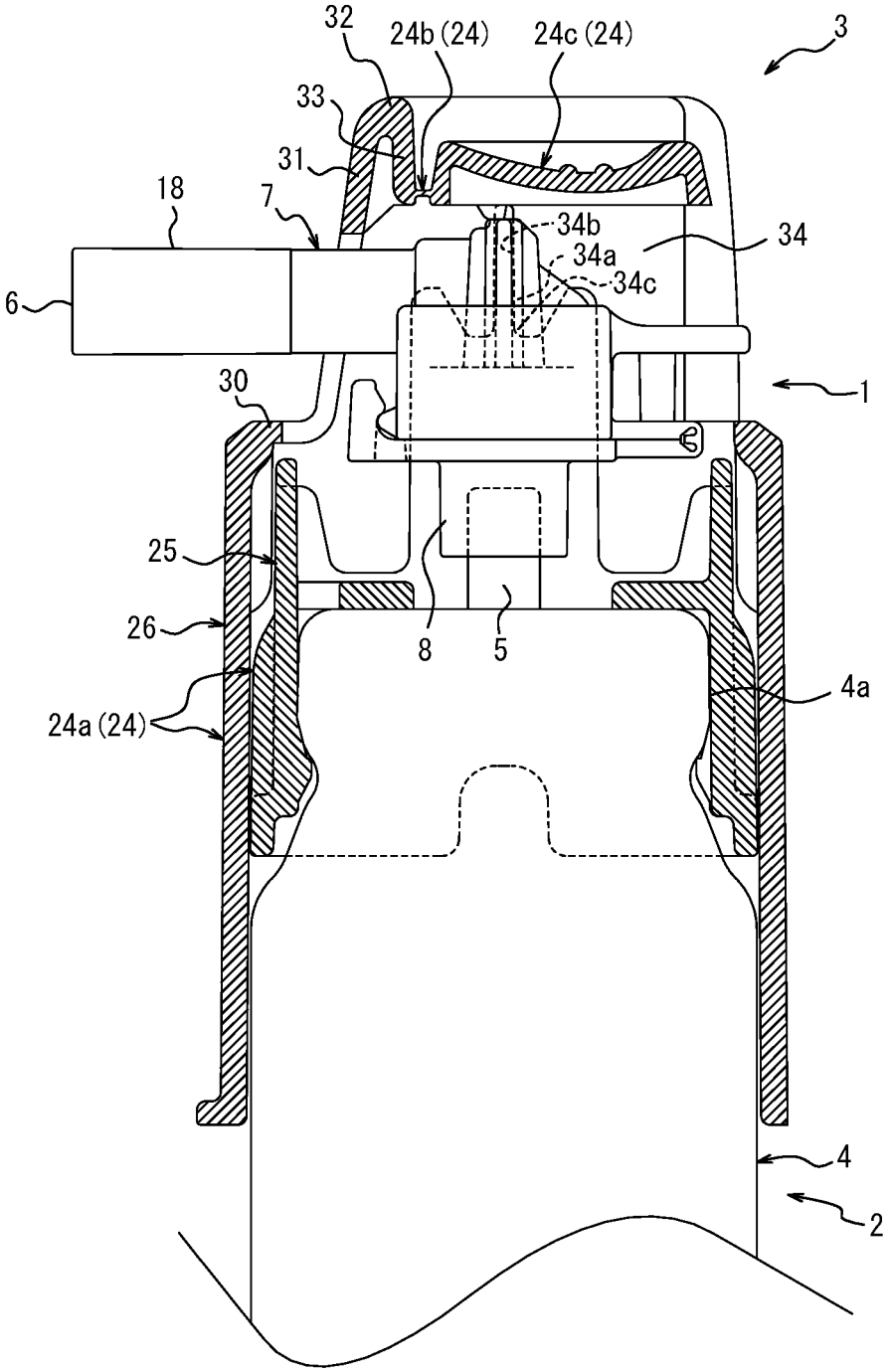
FIG. 1 is a partial sectional side view illustrating an aerosol device formed by attaching a dispenser for aerosol containers according to Embodiment 1 of the present disclosure to a pair of aerosol containers, in a state before a nozzle is depressed.

A dispenser for aerosol containers according to Embodiment 1 of the present disclosure will be described in detail below, with reference to FIGS. 1 to 13. As illustrated in FIG. 1, a dispenser 1 for aerosol containers (hereafter also simply referred to as "dispenser 1") according to this embodiment forms an aerosol device 3 by being attached to a pair of aerosol containers 2 arranged in parallel. Each aerosol container 2 is of single stem type that includes: an aerosol container body 4 (hereafter also simply referred to as "container body 4") including a containing portion for containing contents; and a single stem 5 connected to the container body 4 so as to be depressible. The stem 5 is a cylindrical stem erected on the upper part of the container body 4, and the inside of the stem 5 is a flow path for the contents. When the stem 5 is depressed against a biasing force, a valve in the container body 4 is gradually opened depending on the depression amount of the stem 5, and is fully open at a predetermined depression position. The stem 5 can cause the contents of the flow volume corresponding to the opening of the valve to flow out of the containing portion through the flow path in the stem 5. Hence, the flow volumes of the contents flowing out of the pair of stems 5 are at a maximum at the predetermined depression position. The container body 4 is formed by fastening a mounting cup 4*a* made of metal to a bottomed cylindrical outer container made of metal, synthetic resin, or the like by, for example, winding its outer edges. The structure of the container body 4 may be changed as appropriate. The contents contained in the pair of aerosol containers 2 are of different types, which, when mixed, can achieve desired effects. Alternatively, the contents contained in the pair of aerosol containers 2 may be of the same type.

As illustrated in FIGS. 1 and 2, the dispenser 1 includes a nozzle 7 including a dispensing port 6 for the contents and integrally connectable to the pair of stems 5. As illustrated in FIGS. 5 to 8, the nozzle 7 includes a lower nozzle 9 including a pair of cylindrical connection tubes 8 that are fitted to the pair of stems 5, and an upper nozzle 11 connected to the lower nozzle 9 via a pair of hinges 10 and including the dispensing port 6. In this embodiment, the nozzle 7 is composed of two members obtained by, for example, injection molding of synthetic resin. That is, the nozzle 7 is composed of a tip member 7*a* forming a tip part of a dispensing tube 18 having the dispensing port 6, and a nozzle body member 7*b* forming the rest of the nozzle 7. The nozzle 7 may be composed of one member, or three or more members.

Figure 5:
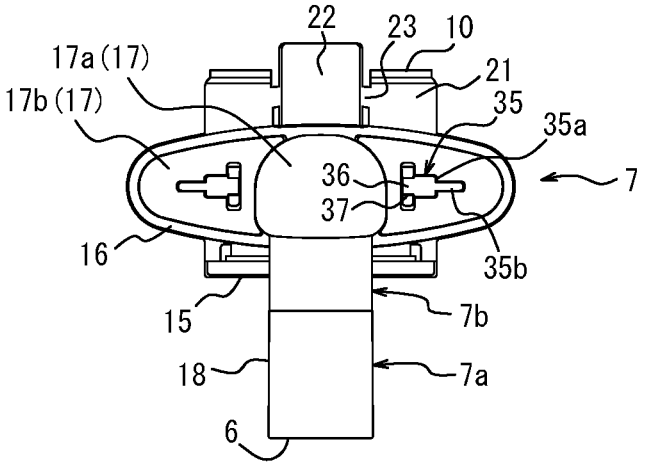
FIG. 5 is a top view of the nozzle illustrated in FIG. 1.
Figure 6:
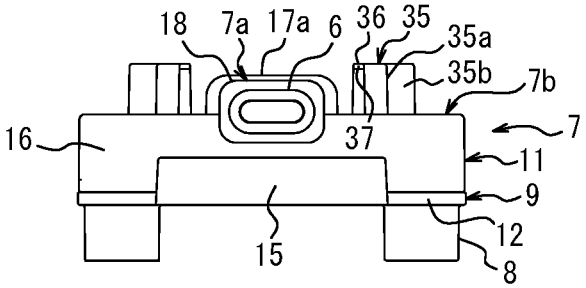
FIG. 6 is a front view of the nozzle illustrated in FIG. 1.
Figure 7:
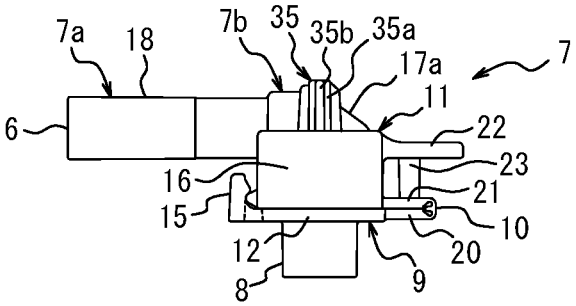
FIG. 7 is a side view of the nozzle illustrated in FIG. 1.

The lower nozzle 9 has a plate-like nozzle bottom wall 12 that is approximately elliptical in a top view and extends horizontally. The connection tubes 8 are suspended from both side parts of the nozzle bottom wall 12. As illustrated in FIG. 2, an annular step portion 8*a* that abuts the upper end surface of the stem 5 is provided on the inner peripheral surface of each connection tube 8. An inner tube wall 13 is erected near the outer peripheral edge of the nozzle bottom wall 12, over the whole circumference. A partition wall 14 that divides the space surrounded by the inner tube wall 13 into right and left parts is provided in a center part of the inner tube wall 13 in the right-left direction. As illustrated in FIGS. 5 to 7, an engagement piece 15 capable of holding the nozzle 7 in an assembled state of fitting the lower nozzle 9 to the upper nozzle 11 is provided in a front part of the nozzle bottom wall 12.

As illustrated in FIGS. 2 and 5 to 8, the upper nozzle 11 has an outer tube wall 16 that is fitted to the inner tube wall 13 from the outer peripheral side, and extends upward over the upper end of the inner tube wall 13. The outer tube wall 16 is an annular wall that is approximately elliptical in a top view. A nozzle top wall 17 is integrally connected to an intermediate part of the outer tube wall 16 in the up-down direction. A center part of the nozzle top wall 17 in the right-left direction forms a bulging portion 17*a* curved in a dome shape. Both right and left side parts of the nozzle top wall 17 with the bulging portion 17*a* therebetween form a pair of lateral top walls 17*b* extending horizontally. A base end part of the dispensing tube 18 in a rectangular tube shape extending in the front-back direction is integrally connected to a front part of the bulging portion 17*a*. The tip part of the dispensing tube 18 has the dispensing port 6. As illustrated in FIG. 2, a partition plate 19 that is fitted to the partition wall 14 to divide the part of the flow path inside the nozzle 7 upstream from the base end part of the dispensing tube 18 into right and left parts is integrally connected to a center part of the bulging portion 17*a* in the right-left direction.

As illustrated in FIGS. 5 and 7, a pair of horizontally extending plate-like lower connection pieces 20 that are arranged in parallel on the right and the left are integrally connected to a back part of the nozzle bottom wall 12 of the lower nozzle 9. A pair of horizontally extending plate-like upper connection pieces 21 that are arranged in parallel on the right and the left are integrally connected to a lower end part of the back part of the outer tube wall 16 of the upper nozzle 11. A back end part of each lower connection piece 20 is connected to a back end part of the corresponding upper connection piece 21 via the hinge 10.

Figure 8:
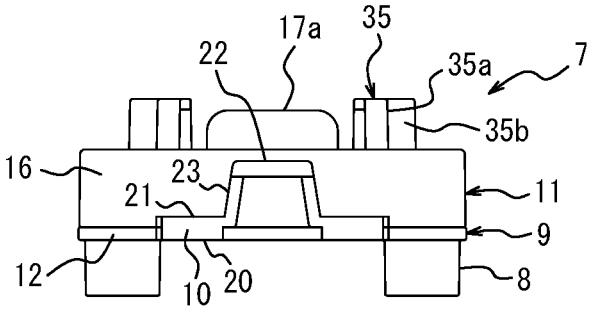
FIG. 8 is a back view of the nozzle illustrated in FIG. 1.

As illustrated in FIGS. 5, 7, and 8, a horizontally extending plate-like stopper piece 22 is integrally connected to an upper part of the back part of the outer tube wall 16. The stopper piece 22 is located in a center part of the back part of the outer tube wall 16 in the right-left direction, and both side parts of the stopper piece 22 are integrally connected to the respective nearby upper connection pieces 21 via support pieces 23. The stopper piece 22 may be omitted from the nozzle 7.

As illustrated in FIG. 1, the dispenser 1 further includes a cover 24 including: a support portion 24*a* integrally connectable to the pair of aerosol container bodies 4; and an operating portion 24*c* connected to the support portion 24*a* via a hinge 24*b* so as to be vertically swingable. In this embodiment, the cover 24 is composed of two members, i.e. a fixed member (fixed platen) 25 and a cover body member (cover body) 26. The hinge 24*b* and the operating portion 24*c* are formed by part of the cover body 26, and the support portion 24*a* is formed by the remaining part of the cover body 26 and the fixed platen 25. The cover 24 may be composed of one member, or three or more members.

Figure 4:
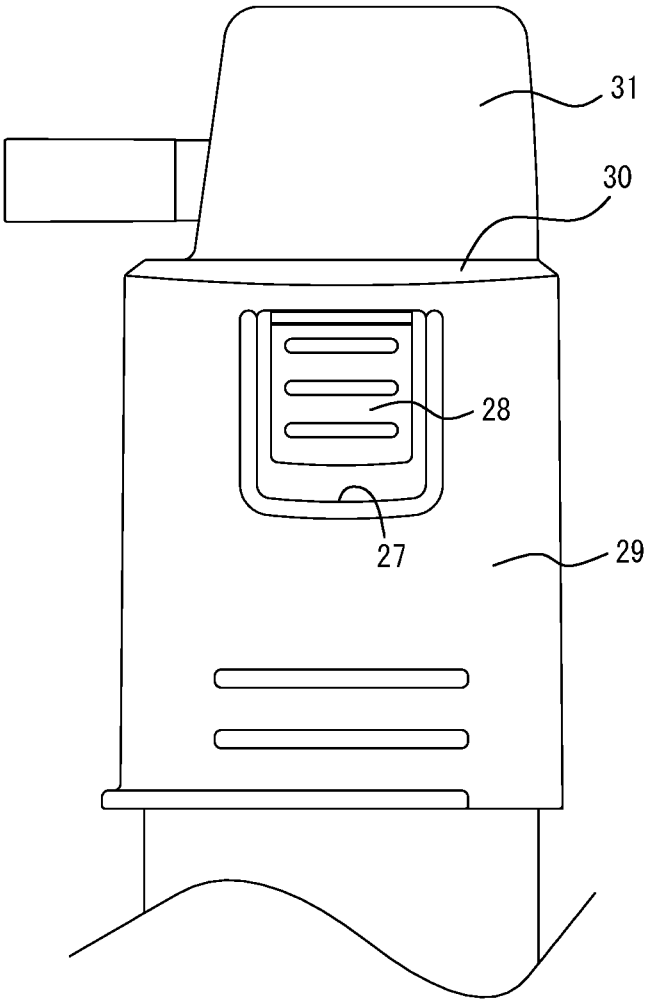
FIG. 4 is a side view of the aerosol device illustrated in FIG. 1.

As illustrated in FIGS. 1 and 2, the fixed platen 25 is fixed to the mounting cups 4*a* of the pair of aerosol containers 2 arranged in parallel on the right and the left, by fitting. The structure of the fixed platen 25 may be changed as appropriate. The cover body 26 is detachably attached to the fixed platen 25. As illustrated in FIGS. 2 and 4, the cover body 26 includes a pair of locking portions 27 that can be locked to both side parts of the fixed platen 25, and a pair of attaching/detaching levers 28 capable of switching the locking/unlocking state of the locking portions 27. The pair of locking portions 27 and the pair of attaching/detaching levers 28 are formed by U-shaped notches in both side parts of a lower outer peripheral wall 29 that is approximately elliptical in a top view and covers the outer peripheral part of the fixed platen 25 over the whole circumference.

As illustrated in FIGS. 2 and 3, the outer peripheral edge of an inward annular step portion 30 that is approximately elliptical in a top view is integrally connected to the upper end edge of the lower outer peripheral wall 29. An upper outer peripheral wall 31 is erected on the inner peripheral edge of the inward annular step portion 30. The upper outer peripheral wall 31 has a front opening through which the dispensing tube 18 of the nozzle 7 passes. The upper outer peripheral wall 31 is notched in a part located behind the operating portion 24*c* as seen from above. A cover top wall 32 that is approximately U-shaped in a top view and extends horizontally is integrally connected to the upper end edge of the upper outer peripheral wall 31. An upper inner peripheral wall 33 that is approximately U-shaped in a top view is suspended from the inside edge of the cover top wall 32. As illustrated in FIG. 1, a front part of the upper inner peripheral wall 33 has its lower end part terminating above the nozzle 7. A front end part of the operating portion 24*c* is connected to the lower end part of the front part of the upper inner peripheral wall 33 by the hinge 24*b*. The operating portion 24*c* is approximately rectangular in a top view, and its upper surface forms a downward recessed pressed surface subjected to a pressing operation by a user.

As illustrated in FIGS. 1 and 2, both side parts of the upper inner peripheral wall 33 constitute a pair of guiding walls 34 that form guiding surfaces 34*a* facing each other. Each guiding wall 34 is notched from below, to have a guiding slit 34*b* extending in the up-down direction. As illustrated in FIG. 1, a lower end part 34*c* of each guiding wall 34 enters the inside of the outer tube wall 16 of the nozzle 7 in a state before the nozzle 7 is depressed.

Figure 11:
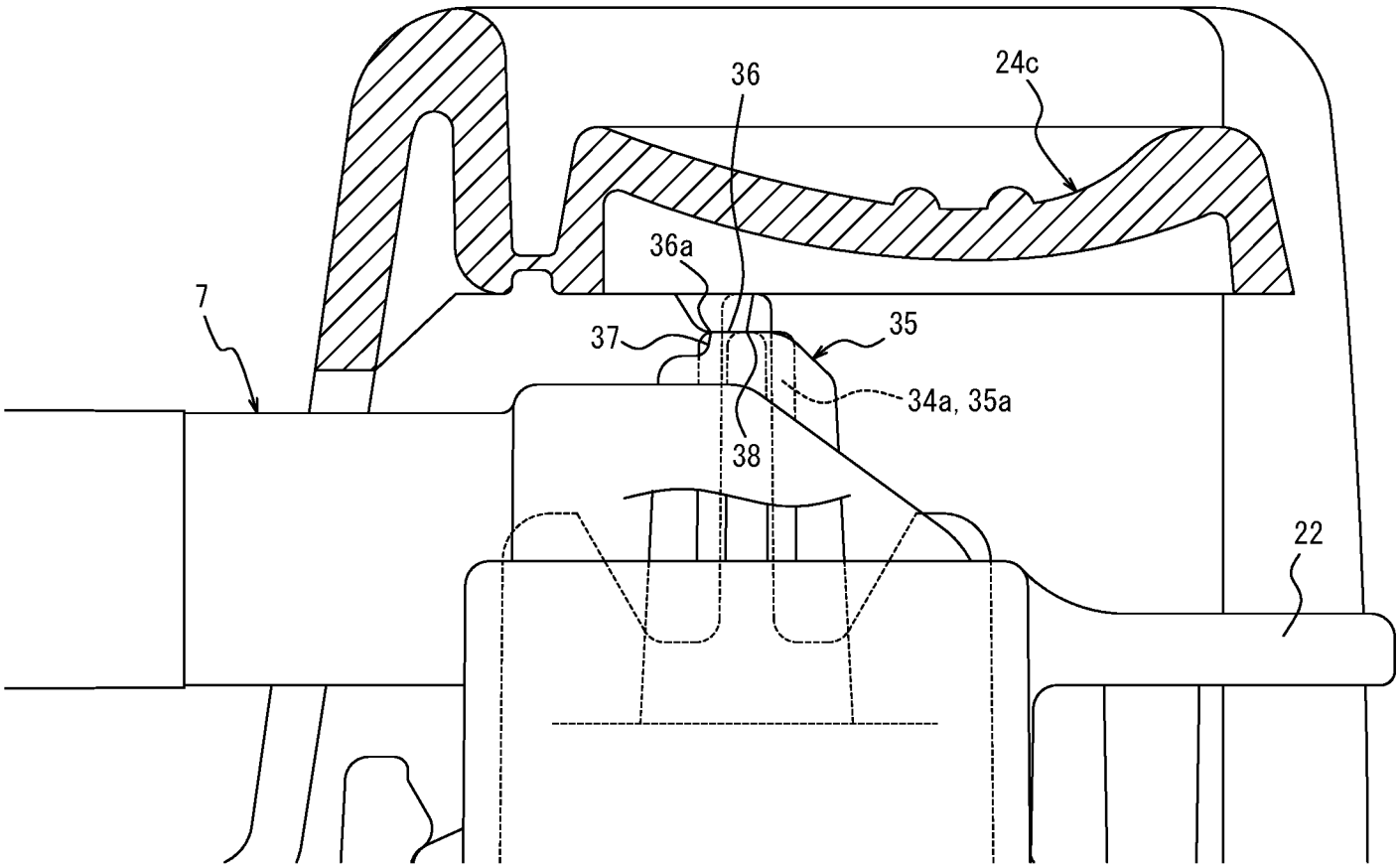
FIG. 11 is a partial sectional side view illustrating the positional relationship between a sliding portion and a slid portion in the state illustrated in FIG. 1.

As illustrated in FIGS. 2 and 5 to 8, the nozzle 7 includes a pair of guided convex portions 35 that form guided surfaces 35*a* guided by the respective guiding surfaces 34*a* (see FIG. 2). Each guided convex portion 35 includes a guided piece 35*b* guided by the guiding slit 34*b*. As illustrated in FIGS. 5, 6, and 11, each guided convex portion 35 includes the below-described slid portions 36 and vibration generation portions 37. As illustrated in FIGS. 2 and 11, the operating portion 24*c* includes the below-described pair of sliding portions 38.

Figure 12:
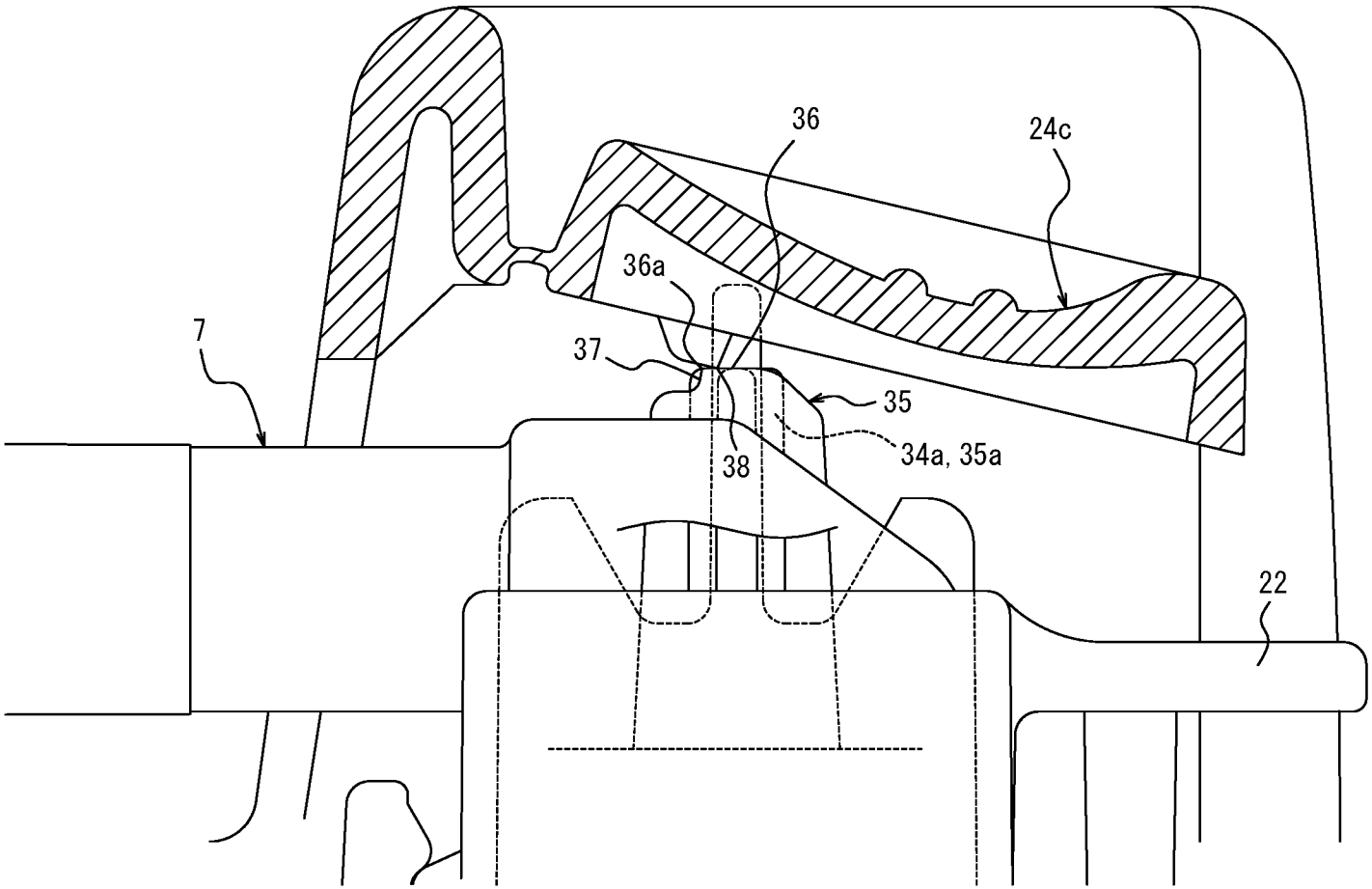
FIG. 12 is a partial sectional side view illustrating the positional relationship between the sliding portion and the slid portion in the state illustrated in FIG. 9.
Figure 13:
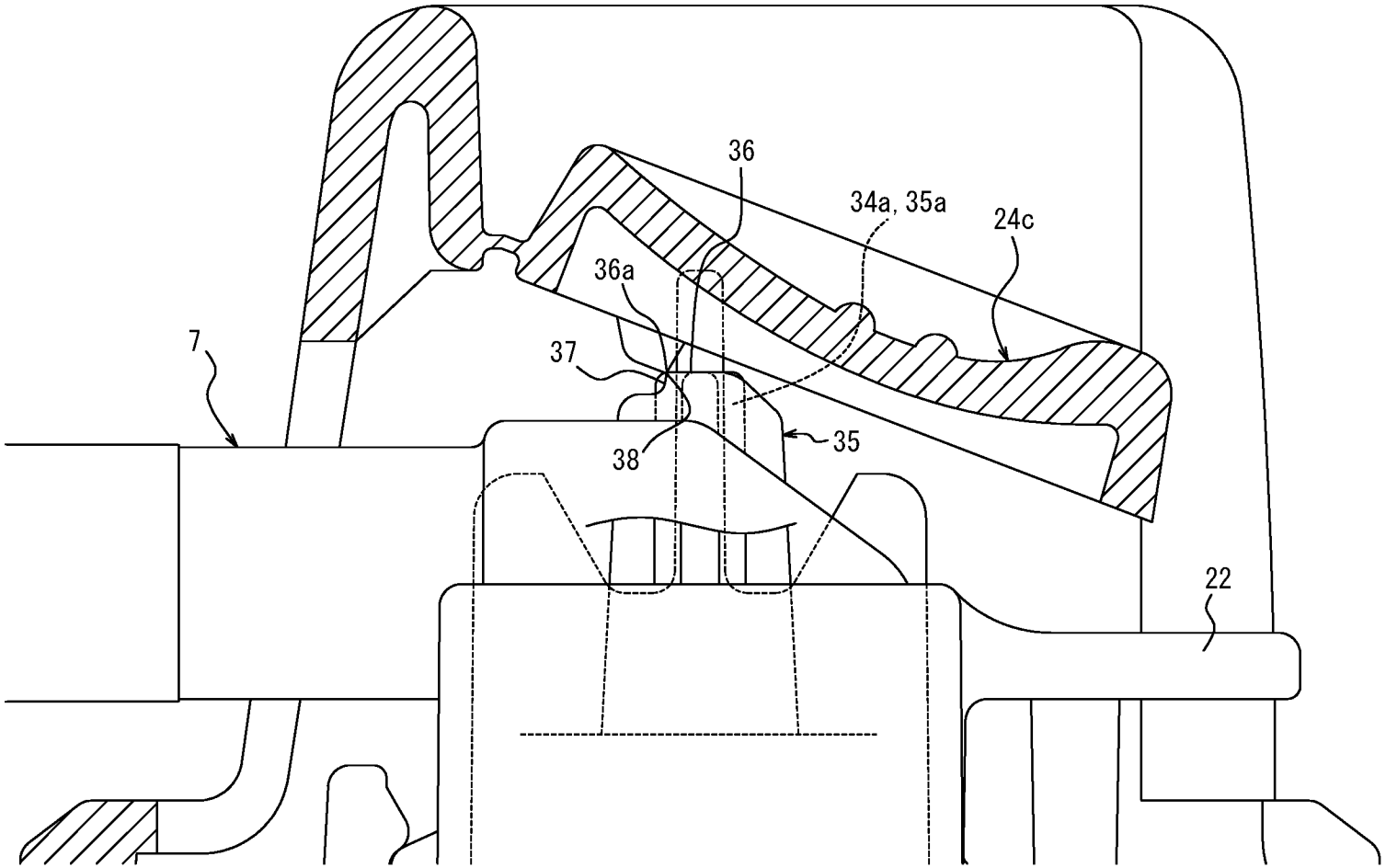
FIG. 13 is a partial sectional side view illustrating the positional relationship between the sliding portion and the slid portion in the state illustrated in FIG. 10.

As illustrated in FIGS. 11 to 13, the operating portion 24*c* includes the sliding portions 38 capable of depressing the nozzle 7 to a predetermined depression position together with the pair of stems 5 while sliding on the slid portions 36 provided at the nozzle 7 to terminations 36*a*, with a depression operation on the operating portion 24*c*. The sliding portions 38 are formed by back end parts of the lower end surfaces of a pair of convex portions protruding downward from both side parts of the operating portion 24*c*. The termination 36*a* of each slid portion 36 is provided with the vibration generation portion 37 that generates vibration as a result of the entry of the sliding portion 38. In this embodiment, the vibration generation portion 37 is formed by a step portion that makes the termination 36*a* of the slid portion 36 a convex corner portion. As illustrated in FIG. 13, the vibration generation portion 37 can generate vibration as a result of the sliding portion 38 passing over the corner portion and falling into the step portion. The vibration allows the user to perceive that the operating portion 24*c* has been depressed to the sufficient depression position.

The aerosol device 3 according to this embodiment can be assembled as follows. First, the fixed platen 25 is attached to the pair of aerosol containers 2. The cover body 26 in which the nozzle 7 is incorporated is then attached to the fixed platen 25. Here, by placing the dispensing tube 18 and the stopper piece 22 of the nozzle 7 on the inward annular step portion 30, the nozzle 7 can be stably held inside the cover body 26. As a result of such attachment, each connection tube 8 of the nozzle 7 is integrally connected to the corresponding stem 5, thus setting the aerosol device 3 in a usable state as illustrated in FIG. 1.

Figure 9:
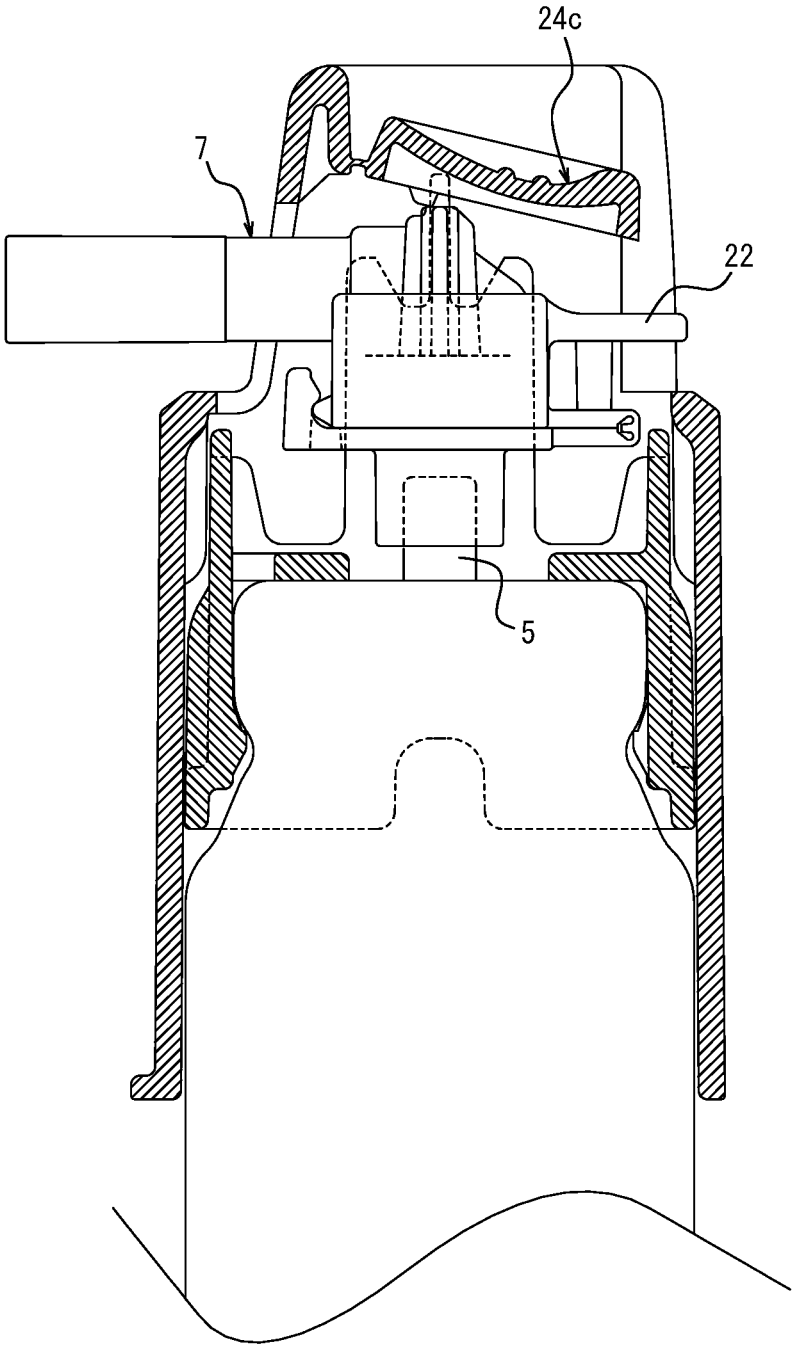
FIG. 9 is a partial sectional side view illustrating the aerosol device illustrated in FIG. 1, in a state in which the nozzle is being depressed toward a predetermined depression position.
Figure 10:
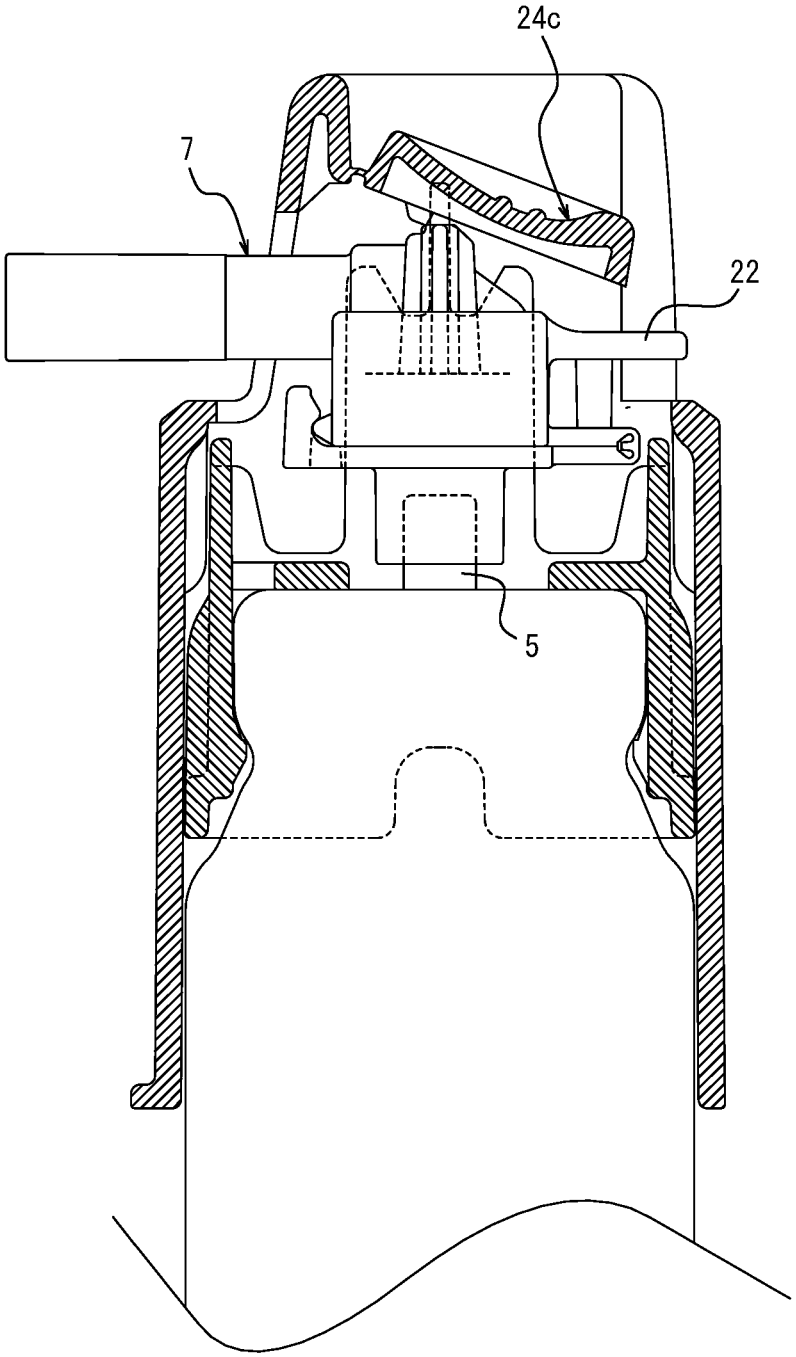
FIG. 10 is a partial sectional side view illustrating the aerosol device illustrated in FIG. 1, in a state in which the nozzle has been depressed to the predetermined depression position.

The aerosol device 3 is used as follows. First, the user grasps the lower outer peripheral wall 29 of the cover 24, and depresses the operating portion 24*c* with the index finger or the like from the state illustrated in FIG. 11. As a result, each sliding portion 38 of the operating portion 24*c* presses the corresponding slid portion 36 of the nozzle 7 downward and thus depresses the nozzle 7, as illustrated in FIGS. 12 and 9. Here, since the nozzle 7 descends while each guiding surface 34*a* is guiding the corresponding guided surface 35*a*, the nonuniformity of the depression amounts of the pair of stems 5 is reduced. Further, with the downward swing of the operating portion 24*c*, each sliding portion 38 slides forward on the corresponding slid portion 36. When the pair of stems 5 are depressed to the predetermined depression position, each sliding portion 38 reaches the termination 36*a* of the slid portion 36, and falls into the vibration generation portion 37 formed by the step portion, as illustrated in FIGS. 13 and 10. Vibration generated by this fall is transmitted to the finger through the operating portion 24*c*, as a result of which the user can perceive that the operating portion 24*c* has been sufficiently depressed. Hence, for example, by instructing the user to depress the operating portion 24*c* until vibration is felt by means of a manual or the like beforehand, an insufficient depression operation on the operating portion 24*c* can be prevented. Consequently, problems caused by an insufficient depression operation, such as the contents flowing out of only one stem 5 or the flow volumes of the contents flowing out of both stems 5 being significantly nonuniform, can be prevented. Thus, according to this embodiment, the nonuniformity of the flow volumes of the contents flowing out of the pair of stems 5 can be reduced. Moreover, in the case where the operating portion 24*c* is depressed to a position significantly exceeding the sufficient depression position, a back end part of the operating portion 24*c* comes into contact with the stopper piece 22, so that further depression can be restricted.

After the use of the aerosol device 3, the aerosol device 3 can be cleaned as follows. First, the attaching/detaching lever 28 of the cover body 26 is pressed to disengage the locking portion 27 from the fixed platen 25, and the cover body 26 is detached from the fixed platen 25 together with the nozzle 7. Next, the tip member 7*a* is detached from the nozzle body member 7*b*, and the nozzle body member 7*b* is taken out of the cover body 26. The engagement piece 15 is then operated to open the nozzle body member 7*b*. That is, the lower nozzle 9 is rotated via the hinge 10 relative to the part of the nozzle body member 7*b* constituting the upper nozzle 11, to open the inside flow path. By disassembling and opening the nozzle 7 in this way, the flow path inside the nozzle 7 can be easily cleaned.

Figure 14:
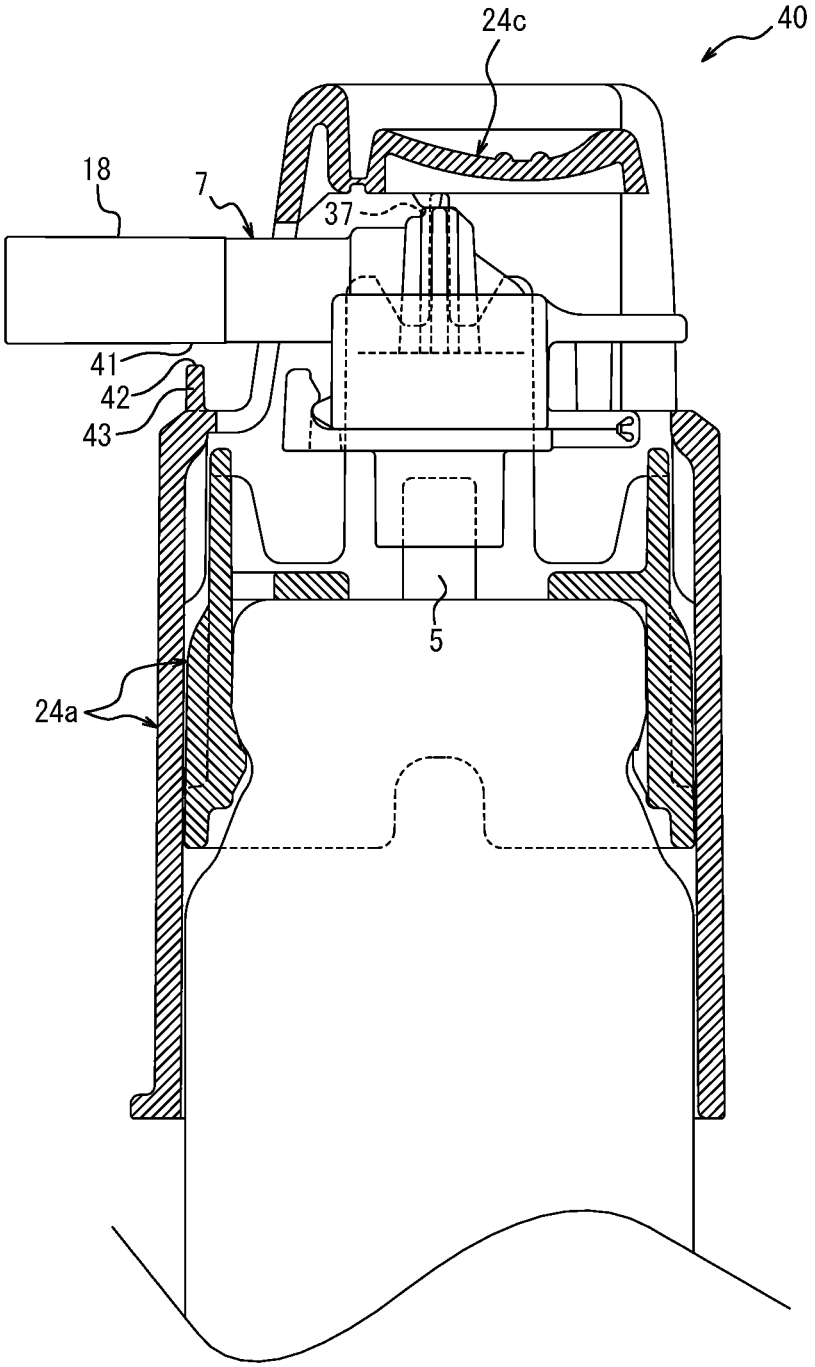
FIG. 14 is a partial sectional side view illustrating an aerosol device formed by attaching a dispenser for aerosol containers according to Embodiment 2 of the present disclosure to a pair of aerosol containers, in a state before a nozzle is depressed.

A dispenser for aerosol containers according to Embodiment 2 of the present disclosure will be described in detail below, with reference to FIGS. 14 to 16. As illustrated in FIG. 14, a dispenser 40 for aerosol containers according to this embodiment is the same as that in Embodiment 1, except that the nozzle 7 includes an abutting portion 41 and the support portion 24*a* includes an abutted portion 42.

In this embodiment, the nozzle 7 includes the abutting portion 41 that abuts the abutted portion 42 of the support portion 24*a* so as to correct a tilt of the nozzle 7 in a plane (a plane corresponding to the surface of paper of FIG. 14) perpendicular to the direction in which the pair of stems 5 are arranged in parallel, with a depression operation on the operating portion 24*c*. The abutted portion 42 is formed by the upper end of a rib 43 extending in the up-down direction directly below the dispensing tube 18.

Figure 15:
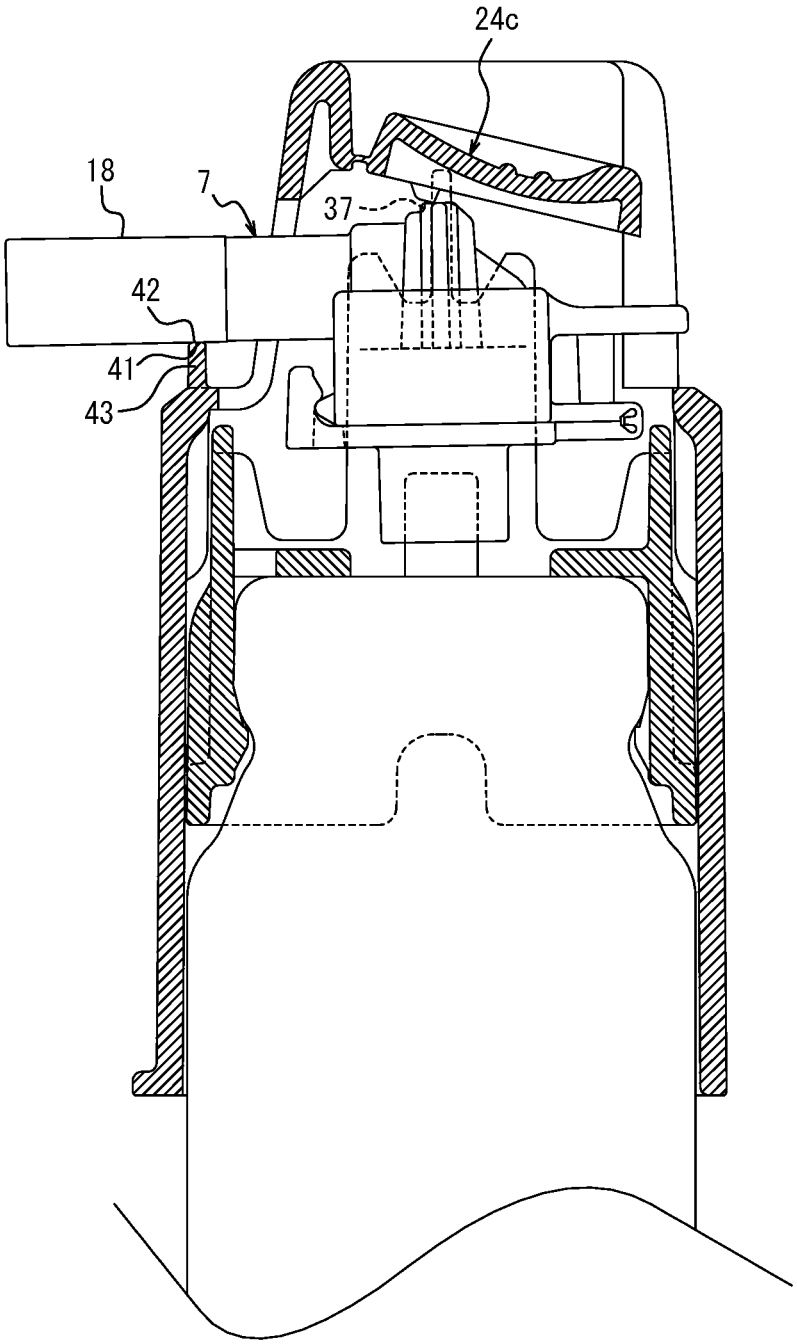
FIG. 15 is a partial sectional side view illustrating the aerosol device illustrated in FIG. 14, in a state in which the nozzle is being depressed toward a predetermined depression position.
Figure 16:
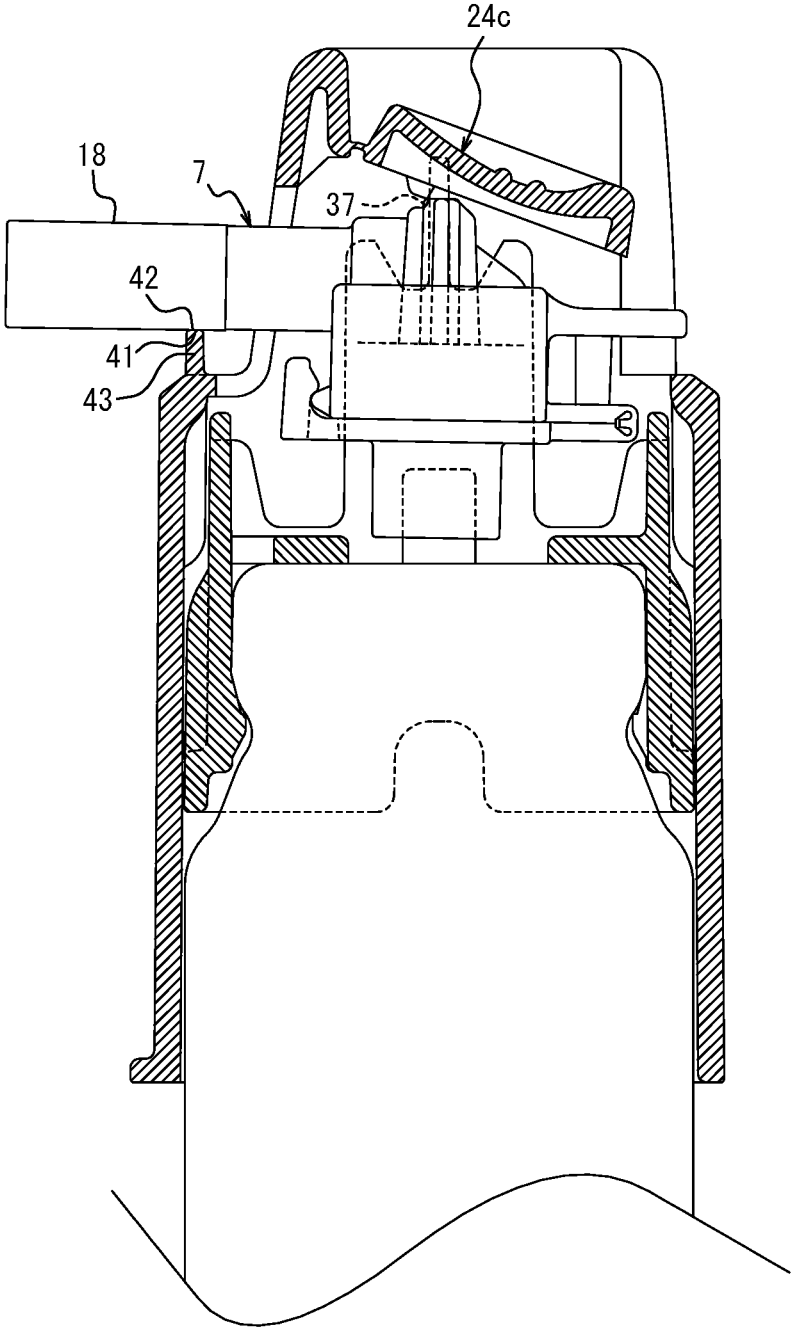
FIG. 16 is a partial sectional side view illustrating the aerosol device illustrated in FIG. 14, in a state in which the nozzle has been depressed to the predetermined depression position.

With such a structure, even in the case where the nozzle 7 tilts forward at the start of the depression operation on the operating portion 24*c* due to, for example, a clearance between members, the abutting portion 41 abuts the abutted portion 42 to thereby correct the forward tilt, so that vibration can be generated by the vibration generation portion 37 at the appropriate depression position, as illustrated in FIGS. 15 to 16. Thus, according to this embodiment, the nonuniformity of the flow volumes of the contents flowing out of the pair of stems 5 can be reduced stably.

Figure 17:
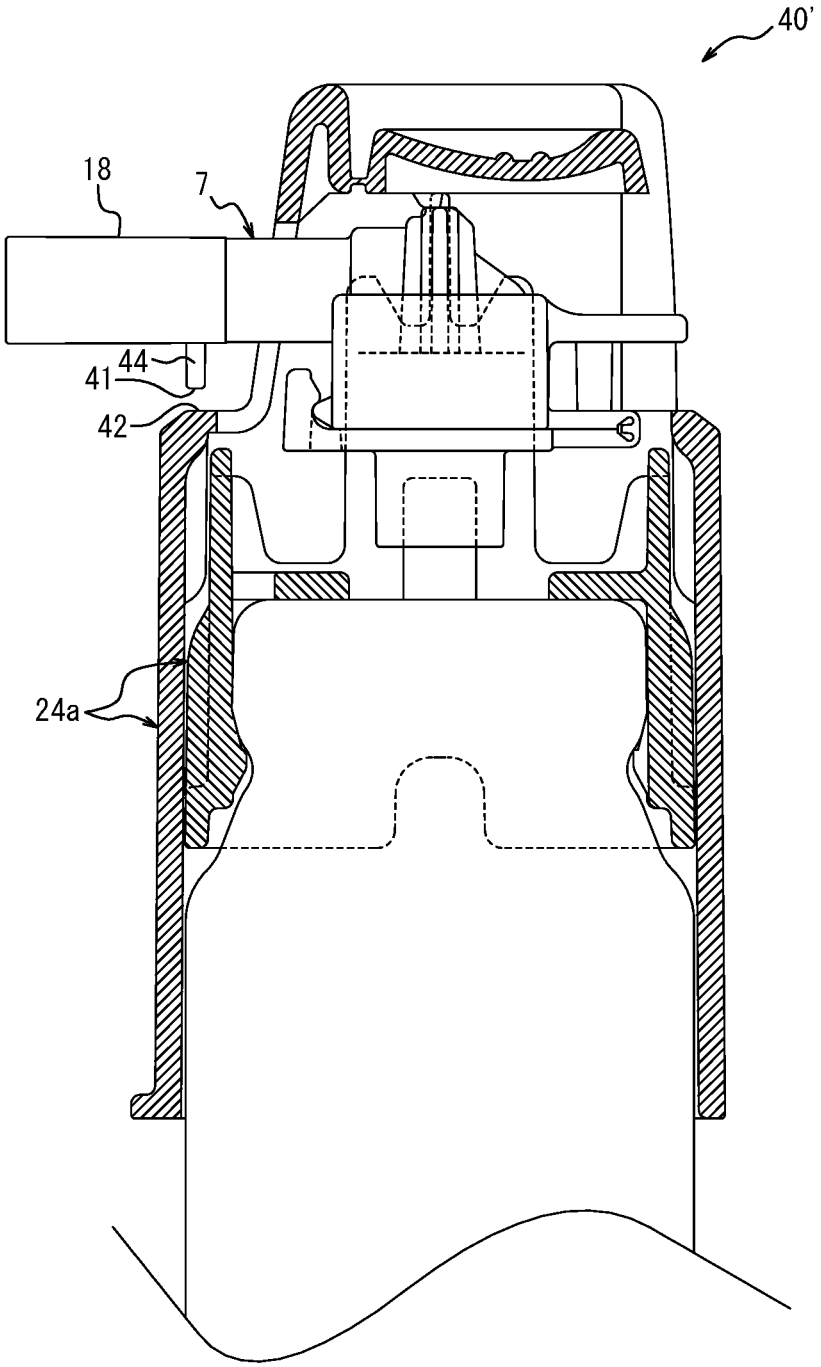
FIG. 17 is a partial sectional side view illustrating an aerosol device formed by attaching a modification of the dispenser for aerosol containers according to Embodiment 2 of the present disclosure to a pair of aerosol containers, in a state before a nozzle is depressed.

In this embodiment, the abutted portion 42 provided at the support portion 24*a* is formed by the upper end of the rib 43 extending in the up-down direction directly below the dispensing tube 18. Instead of this structure, a modification illustrated in FIG. 17 may be used in which the abutting portion 41 provided at the nozzle 7 is formed by the lower end of a rib 44 vertically suspended from the dispensing tube 18. Such a structure can achieve the same effects as in the foregoing Embodiment 2.

Figure 18:
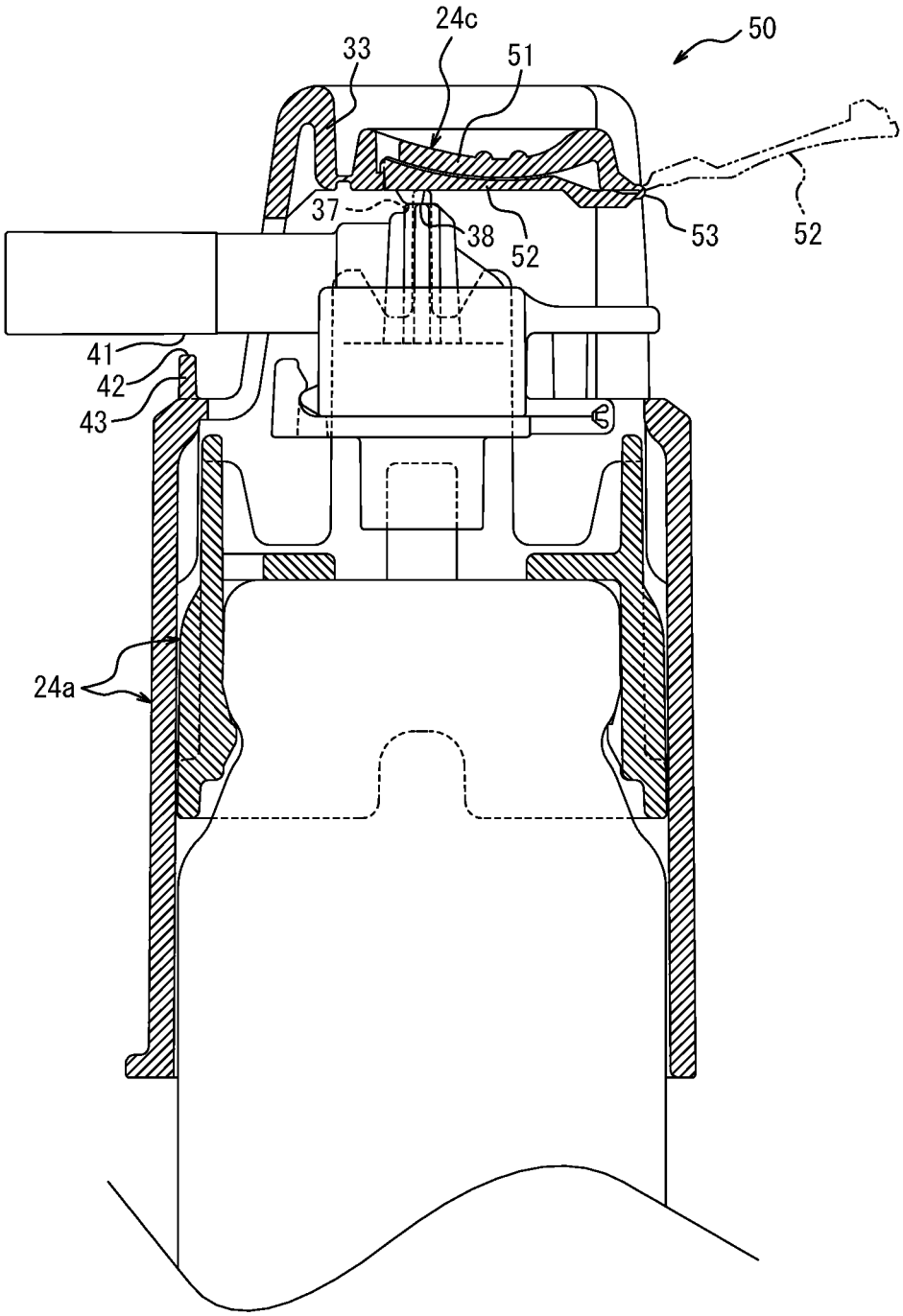
FIG. 18 is a partial sectional side view illustrating an aerosol device formed by attaching a dispenser for aerosol containers according to Embodiment 3 of the present disclosure to a pair of aerosol containers, in a state before a nozzle is depressed.
Figure 19:
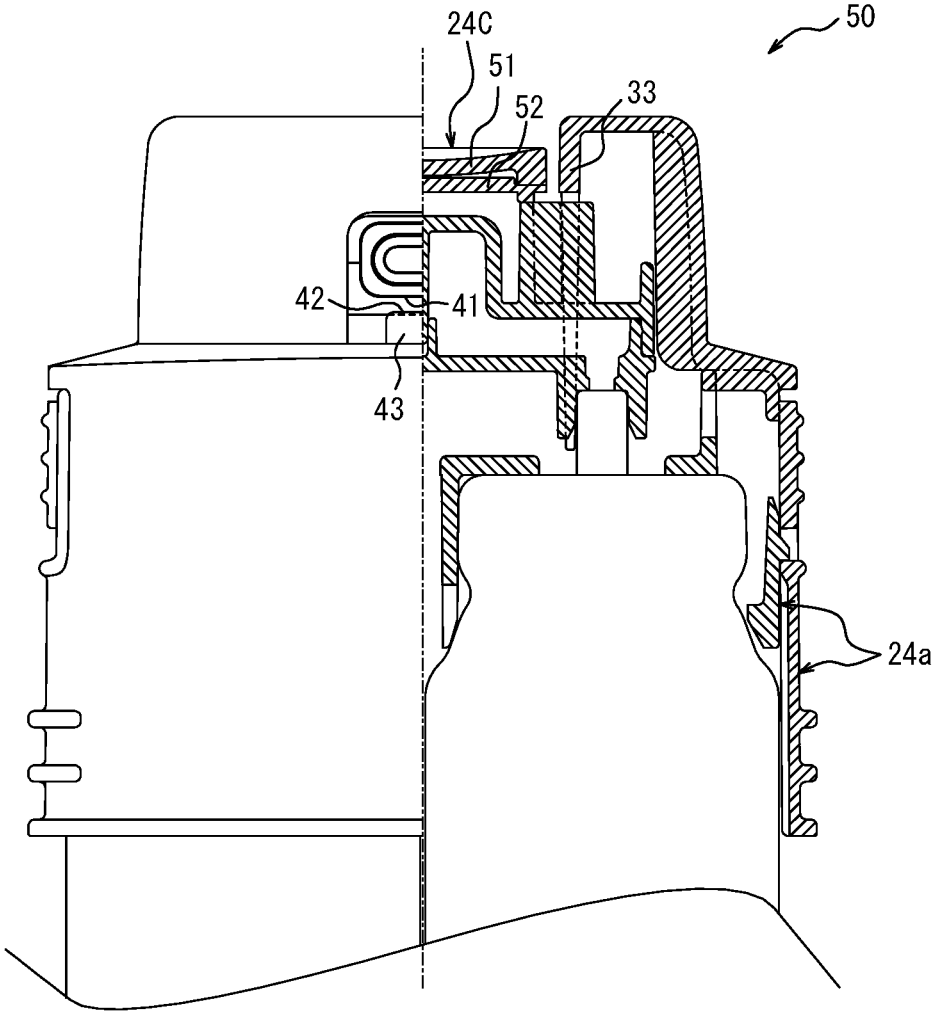
FIG. 19 is a partial sectional front view of the aerosol device illustrated in FIG. 18.

A dispenser for aerosol containers according to Embodiment 3 of the present disclosure will be described in detail below, with reference to FIGS. 18 to 19. As illustrated in FIGS. 18 to 19, a dispenser 50 for aerosol containers according to this embodiment is the same as that in Embodiment 2, except that the operating portion 24*c* includes a top plate 51 and a bottom plate 52.

In this embodiment, the operating portion 24*c* includes: the top plate 51 connected to the support portion 24*a* via the hinge 24*b* so as to be vertically swingable; and the bottom plate 52 fixed to the lower surface of the top plate 51. A front end part of the top plate 51 is connected to the lower end part of the front part of the upper inner peripheral wall 33 of the support portion 24*a*. The bottom plate 52 is connected to the back end of the top plate 51 via a hinge 53. The bottom plate 52 is fixed to the lower surface of the top plate 51 by fitting, as a result of being rotated via the hinge 53. The sliding portions 38 are formed by back end parts of the lower end surfaces of a pair of convex portions protruding downward from both side parts of the bottom plate 52.

With such a structure, the operating portion 24*c* has a double structure, so that the sound generated together with the vibration as a result of the entry of the sliding portion 38 into the vibration generation portion 37 with the depression operation on the operating portion 24*c* can be made louder and clearer. Thus, according to this embodiment, the non-uniformity of the flow volumes of the contents flowing out of the pair of stems 5 can be reduced stably.

Figure 20:
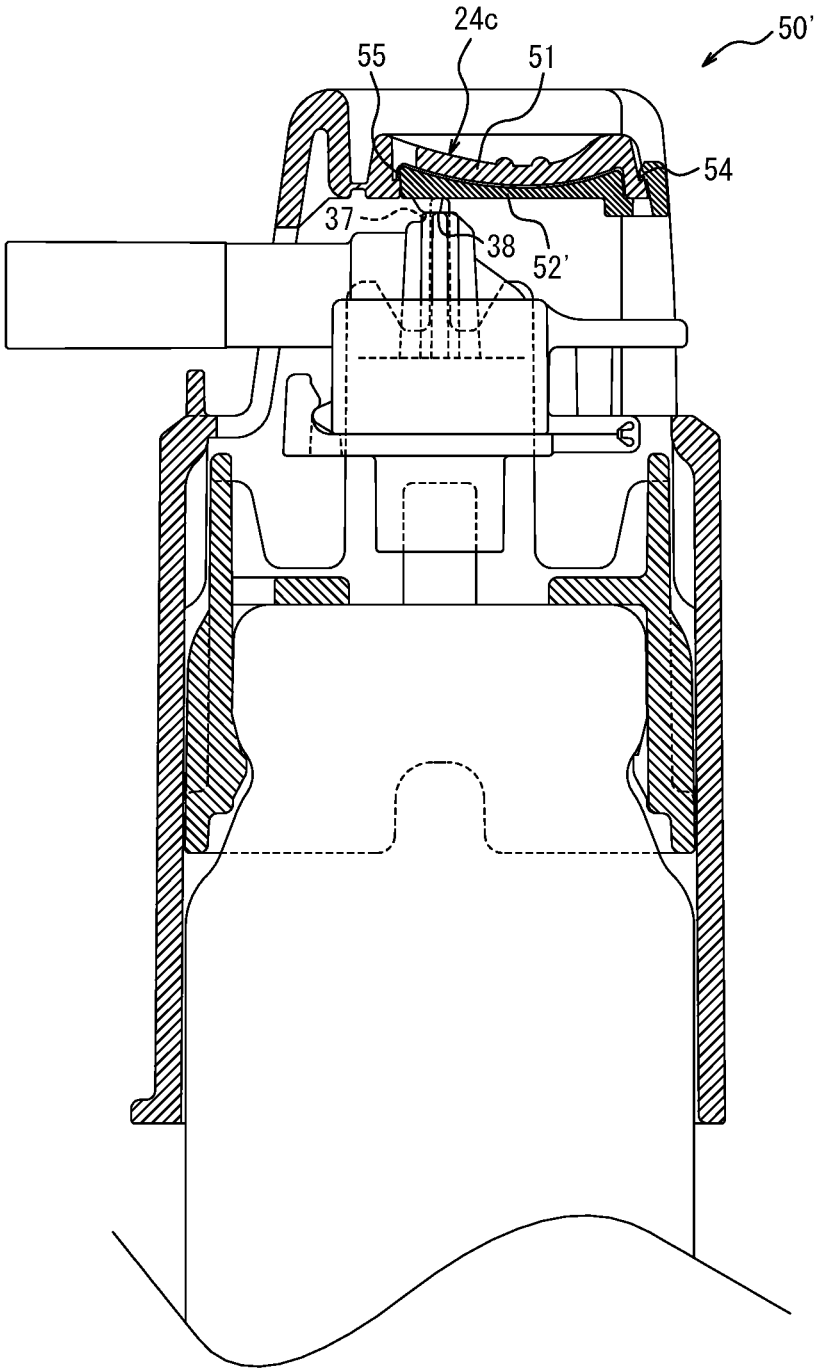
FIG. 20 is a partial sectional side view illustrating an aerosol device formed by attaching a modification of the dispenser for aerosol containers according to Embodiment 3 of the present disclosure to a pair of aerosol containers, in a state before a nozzle is depressed.

In this embodiment, the bottom plate 52 is connected to the top plate 51 via the hinge 53. Instead of this structure, a modification illustrated in FIG. 20 may be used in which a bottom plate 52' is formed by a member different from the top plate 51 and is made of a material (e.g. hard resin) harder than the top plate 51. In this modification, the bottom plate 52' includes: a locking portion 54 locked to the back end of the top plate 51; and a fitting portion 55 that can be fitted to the front part of the top plate 51 by rotating the bottom plate 52' relative to the top plate 51 in a state in which the locking portion 54 is locked to the back end of the top plate 51. With such a structure, the bottom plate 52' including the sliding portion 38 is made of a hard material, so that the sound generated together with the vibration as a result of the entry of the sliding portion 38 into the vibration generation portion 37 with the depression operation on the operating portion 24*c* can be made louder and clearer.

The above description merely illustrates some of the disclosed embodiments, and does not limit the scope of the claims. Various changes such as the following can be made to the foregoing embodiments based on the fundamental matters of the present disclosure.

In each of the foregoing embodiments, the dispenser for aerosol containers is attachable to a pair of aerosol containers of single stem type.

Alternatively, the dispenser may be attachable to three or more aerosol containers of single stem type. The dispenser may be attachable to a single aerosol container of multiple stem type including a plurality (e.g. a pair) of stems arranged in parallel in an upper part of an aerosol container body.

In each of the foregoing embodiments, the vibration generation portion is formed by the step portion that makes the termination of the slid portion a convex corner portion. Alternatively, the vibration generation portion may be formed by a step portion that makes the termination of the slid portion a concave corner portion. In each of the foregoing embodiments, the sliding portion is provided at the operating portion, and the slid portion and the vibration generation portion are provided at the nozzle. Alternatively, the sliding portion may be provided at the nozzle, and the slid portion and the vibration generation portion may be provided at the operating portion.

In each of the foregoing embodiments, each guided convex portion has the guided surface and the guided piece. Alternatively, the guided surface and/or the guided piece may be omitted from each guided convex portion. In each of the foregoing embodiments, a pair of sliding portions, a pair of slid portions, and a pair of vibration generation portions are arranged in parallel on the right and the left. Alternatively, only one sliding portion, one slid portion, and one vibration generation portion may be provided in the center parts of the nozzle and the operating portion in the right-left direction.

In each of the foregoing embodiments, the predetermined depression position is a position at which the flow volumes of the contents flowing out of the pair of stems are at a maximum. Alternatively, the predetermined depression position may be a position above or below the position at which the flow volumes of the contents flowing out of the pair of stems are at a maximum.

REFERENCE SIGNS LIST

1 dispenser for aerosol container
2 aerosol container
3 aerosol device
4 aerosol container body
4*a* mounting cup
5 stem
6 dispensing port
7 nozzle
7*a* tip member
7*b* nozzle body member
8 connection tube
8*a* annular step portion
9 lower nozzle
10 hinge
11 upper nozzle
12 nozzle bottom wall
13 inner tube wall
14 partition wall
15 engagement piece
16 outer tube wall
17 nozzle top wall
17*a* bulging portion
17*b* lateral top wall
18 dispensing tube
19 partition plate
20 lower connection piece
21 upper connection piece
22 stopper piece
23 support piece
24 cover
24*a* support portion
24*b* hinge
24*c* operating portion
25 fixed platen
26 cover body
27 locking portion
28 removable lever
29 lower outer peripheral wall
30 inward annular step portion
31 upper outer peripheral wall
32 cover top wall
33 upper inner peripheral wall
34 guiding wall
34*a* guiding surface
34*b* guiding slit
34*c* lower end of guiding wall
35 guided convex portion
35*a* guided surface
35*b* guided piece
36 slid portion
36*a* termination of slid portion
37 vibration generation portion
38 sliding portion
40, 40' dispenser for aerosol container
41 abutting portion
42 abutted portion
43, 44 rib
50, 50' dispenser for aerosol container
51 top plate
52, 52' bottom plate
53 hinge
54 locking portion
55 fitting portion

The invention claimed is:

1. A dispenser for aerosol containers that is attachable to a plurality of aerosol containers of single stem type arranged in parallel or a single aerosol container of multiple stem type, the dispenser for aerosol containers comprising:

a nozzle including a dispensing port for contents, and integrally connectable to a plurality of stems; and a cover including a support portion integrally connectable to one or more aerosol container bodies, and an operating portion connected to the support portion so as to be vertically swingable, wherein:

one of the operating portion and the nozzle includes a sliding portion capable of depressing the nozzle to a predetermined depression position together with the plurality of stems while sliding on a slid portion provided at an other one of the operating portion and the nozzle to a termination, with a depression operation on the operating portion, a vibration generation portion that generates vibration as a result of entry of the sliding portion is provided at the termination of the slid portion, the support portion of the cover includes a pair of guiding walls forming guiding surfaces facing each other, the nozzle includes a pair of guided convex portions forming guided surfaces guided by the guiding surfaces, each of the pair of guided convex portions includes the slid portion and the vibration generation portion, and the operating portion includes a pair of sliding portions that are each the sliding portion.

2. The dispenser for aerosol containers according to claim 1, wherein the vibration generation portion is formed by a step portion that makes the termination of the slid portion a convex or concave corner portion.

3. The dispenser for aerosol containers according to claim 2, wherein the corner portion is convex.

4. The dispenser for aerosol containers according to claim 1, wherein the operating portion includes the sliding portion, and the nozzle includes the slid portion and the vibration generation portion.

5. The dispenser for aerosol containers according to claim 1, wherein the predetermined depression position is a position at which flow volumes of contents flowing out of the plurality of stems are at a maximum.

6. The dispenser for aerosol containers according to claim 1, wherein each of the pair of guiding walls includes a guiding slit extending in a depression direction of the plurality of stems, and each of the pair of guided convex portions includes a guided piece that is guided by the guiding slit.

7. The dispenser for aerosol containers according to claim 1, wherein the nozzle includes an abutting portion that abuts an abutted portion of the support portion so as to correct a tilt of the nozzle in a plane perpendicular to a direction in which the plurality of stems are arranged in parallel, with the depression operation on the operating portion.

8. The dispenser for aerosol containers according to claim 7, wherein the nozzle includes a dispensing tube having the dispensing port at a tip thereof, and the abutting portion is formed by a lower end of a rib vertically suspended from the dispensing tube.

9. The dispenser for aerosol containers according to claim 1, wherein the operating portion includes a top plate connected to the support portion so as to be vertically swingable, and a bottom plate fixed to a lower surface of the top plate, and one of the bottom plate and the nozzle includes the sliding portion, and an other one of the bottom plate and the nozzle includes the slid portion and the vibration generation portion.

10. The dispenser for aerosol containers according to claim 9, wherein the bottom plate is connected to the top plate via a hinge.

11. The dispenser for aerosol containers according to claim 9, wherein the bottom plate is formed by a member different from the top plate, and is made of a material harder than the top plate.

12. A dispenser for aerosol containers that is attachable to a plurality of aerosol containers of single stem type arranged in parallel or a single aerosol container of multiple stem type, the dispenser for aerosol containers comprising:

a nozzle including a dispensing port for contents, and integrally connectable to a plurality of stems; and a cover including a support portion integrally connectable to one or more aerosol container bodies, and an operating portion connected to the support portion so as to be vertically swingable, wherein:

one of the operating portion and the nozzle includes a sliding portion capable of depressing the nozzle to a predetermined depression position together with the plurality of stems while sliding on a slid portion provided at an other one of the operating portion and the nozzle to a termination, with a depression operation on the operating portion, a vibration generation portion that generates vibration as a result of entry of the sliding portion is provided at the termination of the slid portion, the operating portion includes a top plate connected to the support portion so as to be vertically swingable, and a bottom plate fixed to a lower surface of the top plate, and one of the bottom plate and the nozzle includes the sliding portion, and an other one of the bottom plate and the nozzle includes the slid portion and the vibration generation portion.

* * * * *